US011097927B1

(12) United States Patent
Draper et al.

(10) Patent No.: US 11,097,927 B1
(45) Date of Patent: Aug. 24, 2021

(54) LIFTING MACHINE WITH COUNTERWEIGHT SENSING SYSTEM AND RELATED METHODS

(71) Applicant: Link-Belt Cranes, L.P., LLLP, Lexington, KY (US)

(72) Inventors: Will Draper, Lexington, KY (US); Ben Clark, Versailles, KY (US); Charles M. Watson, Carlisle, KY (US); Bryan Sheroan, Lexington, KY (US); Richard Shultz, Versailles, KY (US); Tim Burdett, Lexington, KY (US)

(73) Assignee: Link-Belt Cranes, L.P., LLLP, Lexington, KY (US)

( * ) Notice: Subject to any disclaimer, the term of this patent is extended or adjusted under 35 U.S.C. 154(b) by 716 days.

(21) Appl. No.: 15/492,625

(22) Filed: Apr. 20, 2017

Related U.S. Application Data

(60) Provisional application No. 62/325,091, filed on Apr. 20, 2016.

(51) Int. Cl.
*B66C 23/76* (2006.01)
*B66C 13/18* (2006.01)
*B66C 23/42* (2006.01)

(52) U.S. Cl.
CPC ..... *B66C 23/76* (2013.01); *B66C 13/18* (2013.01); *B66C 23/42* (2013.01)

(58) Field of Classification Search
CPC ..... B66C 23/76; B66C 23/42; B66C 13/18
See application file for complete search history.

(56) References Cited

U.S. PATENT DOCUMENTS 2,893,299 A * 7/1959 Moir ..... E01C 19/38 212/195
4,773,814 A * 9/1988 Brocklebank ..... E02F 3/30 212/198
5,199,583 A * 4/1993 Weider ..... B66C 23/74 212/178
5,524,777 A 6/1996 Weber
(Continued)

FOREIGN PATENT DOCUMENTS

DE 102014223325 A1 5/2016
WO WO-2012163190 A1 * 12/2012 ..... B66C 23/905
WO WO2012163190 A1 12/2012

*Primary Examiner* — Michael E Gallion
(74) *Attorney, Agent, or Firm* — Dickinson Wright PLLC; Andrew D. Dorisio

(57) ABSTRACT

A lifting machine with a counterweight includes a sensing system for assisting in ensuring proper operating conditions are reliably achieved. The machine includes a lifter for moving the counterweight from a lowered position to a raised position. A first sensor is associated with the lifter for sensing a parameter corresponding to an amount of the counterweight (such as a pressure value associated with the rod end of a lifting cylinder), and a second sensor is provided for sensing a condition of the lifter (such as the position or extended length of the lifting cylinder). The amount of counterweight present may be determined by the output of the first sensor when the lifter is in a pre-determined (e.g., midpoint) position. The operator may be polled to verify the amount of counterweight present, thus providing a check against unintended operating conditions and ensure that reliable operation of the lifting machine is achieved.

25 Claims, 11 Drawing Sheets

(56) References Cited

U.S. PATENT DOCUMENTS

| | | | | |
|---|---|---|---|---|
| 6,050,430 | A * | 4/2000 | Fleagle | B66C 23/74 212/195 |
| 7,340,373 | B2 | 3/2008 | Shimomura | |
| 8,528,755 | B2 * | 9/2013 | Kurotsu | B66C 23/76 212/196 |
| 8,783,477 | B2 | 7/2014 | Camacho et al. | |
| 9,156,663 | B2 | 10/2015 | Roeben et al. | |
| 9,394,146 | B2 * | 7/2016 | Schroder | B66C 23/62 |
| 9,926,174 | B1 * | 3/2018 | Imerman | B66C 23/701 |
| 10,183,848 | B2 * | 1/2019 | Albinger | B66C 23/76 |
| 2011/0192815 | A1 * | 8/2011 | Kurotsu | B66C 23/76 212/196 |
| 2013/0020273 | A1 * | 1/2013 | Chen | B66C 23/76 212/196 |
| 2016/0169413 | A1 * | 6/2016 | Camacho | F16L 1/06 701/50 |

* cited by examiner

LIFTING MACHINE WITH COUNTERWEIGHT SENSING SYSTEM AND RELATED METHODS

This application claims the benefit of U.S. Provisional Patent Application Ser. No. 62/325,091, filed Apr. 20, 2016, the disclosure of which is incorporated herein by reference.

TECHNICAL FIELD

This disclosure relates generally to lifting machines and, more particularly, to a counterweight sensing system for a lifting machine, such as a crane, and related methods.

BACKGROUND

Lifting machines and, in particular, cranes typically include systems for determining and displaying various operational aspects to the operator, who of course may use onboard controls to control the operation of the crane. One such operational aspect that it is desirable to understand is the amount of counterweight present for balancing the load being lifted. Many past systems provide no easy or convenient way to automatically measure the amount of counterweight present in a reliable manner, and instead rely on operator input, which can be prone to error.

Thus, it would be desirable to provide a system whereby the amount of counterweight is automatically detected, which avoids the need for having the crane operator independently determine and input the amount. This would increase the operational efficiency of the crane, and tend to provide a check against possible operator errors in determining the amount of counterweight present. The system could also be adapted to ensure that the sensing is done in the correct manner to thereby ensure reliable operation of the crane.

SUMMARY

According to a first aspect of the disclosure, a lifting machine including a counterweight is provided. The lifting machine includes a lifter for moving the counterweight from a lowered position to a raised position. A first sensor associated with the lifter is provided for sensing a first parameter corresponding to an amount of the counterweight. A second sensor for sensing a condition of the lifter is also provided.

In one embodiment, the lifter comprises a first cylinder, which may be hydraulic, and the first sensor comprises a first pressure sensor associated with a rod end of the first cylinder of the lifter. The second sensor may comprise a sensor for determining a position or extended length of the rod of the first cylinder. The lifter may further include a second cylinder (also possibly hydraulic), and the first sensor may further comprise a second pressure sensor associated with a rod end of a second cylinder of the lifter.

In these or other embodiments, a controller may be provided for receiving an output signal from the first sensor and determining the amount of the counterweight present. The controller may be adapted to stop the lifter upon determining that the lifter has reached a pre-determined position between the lowered position and the raised position. An input may be provided for allowing an operator to verify that the amount of counterweight determined by the controller is correct, and a lock may also be provided for locking the lifter once the operator verifies the amount of counterweight is correct. A platform may also be provided for supporting the counterweight, and the lifter may be adapted for connecting to an upstanding tower on the platform.

According to a second aspect of the disclosure, a lifting machine for associating with a counterweight includes a platform adapted for supporting the counterweight. A first hydraulic cylinder includes a rod adapted for being releasably connected to the platform and for moving the platform from a lowered position to a raised position. A pressure sensor is provided for sensing an amount of pressure on a rod end of the hydraulic cylinder.

The machine may also include a first position sensor for outputting a signal representative of a position of the rod of the first hydraulic cylinder. A second hydraulic cylinder may also be provided for raising and lowering the platform, and a second pressure sensor may be associated with a rod end of the second hydraulic cylinder. A second position sensor may also be provided for outputting a signal representative of a position of the rod of the second hydraulic cylinder.

In these or other embodiments, a controller is provided for receiving a pressure signal from the pressure sensor and determining the amount of the counterweight on the platform. The controller may be adapted to stop the lifter upon determining that the lifter has reached a pre-determined point between the lowered position and the raised position. An input may also be provided for allowing an operator to verify that the amount of counterweight determined by the controller is correct, along with a lock for locking the lifter once the operator verifies the amount of counterweight is correct.

According to still a further aspect of the disclosure, a method of operating a crane comprises raising a counterweight using a lifter. The method may further include sensing a condition and a position of the lifter. Based on the sensed condition and position, the amount of counterweight present may be determined.

The lifter may comprise a hydraulic cylinder. The sensing step may comprise determining a pressure associated with the hydraulic cylinder during a pause in the raising step. The position sensing may comprise sensing whether the lifter is at a raised position, a lowered position, or a position between the raised and lowered position. The method may further include the step of polling an operator to verify the amount of counterweight present.

Yet another aspect of the disclosure pertains to a method of operating a crane using a controller programmed for performing the following steps: (1) automatically sensing an amount of counterweight associated with the crane; and (2) polling an operator of the crane to verify the amount of the counterweight. The crane may include a lifter in the form of a hydraulic cylinder, and the sensing step comprises determining a pressure associated with the hydraulic cylinder during a pause in the raising step. The sensing step may further comprise sensing whether the lifter is at a raised position, a lowered position, or a position between the raised and lowered position. The polling step may comprise providing an input to allow the operator to input the amount of the counterweight, or verify that the sensed amount is correct.

In the following description, there are shown and described several embodiments of a counterweight sensing system for a lifting machine and related methods. As it should be realized, the system and methods are capable of other, different embodiments and their several details are capable of modification in various, obvious aspects all without departing from the inventions as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the invention, and together with the description serve to explain certain principles thereof. In the drawing figures.

Figure 5:
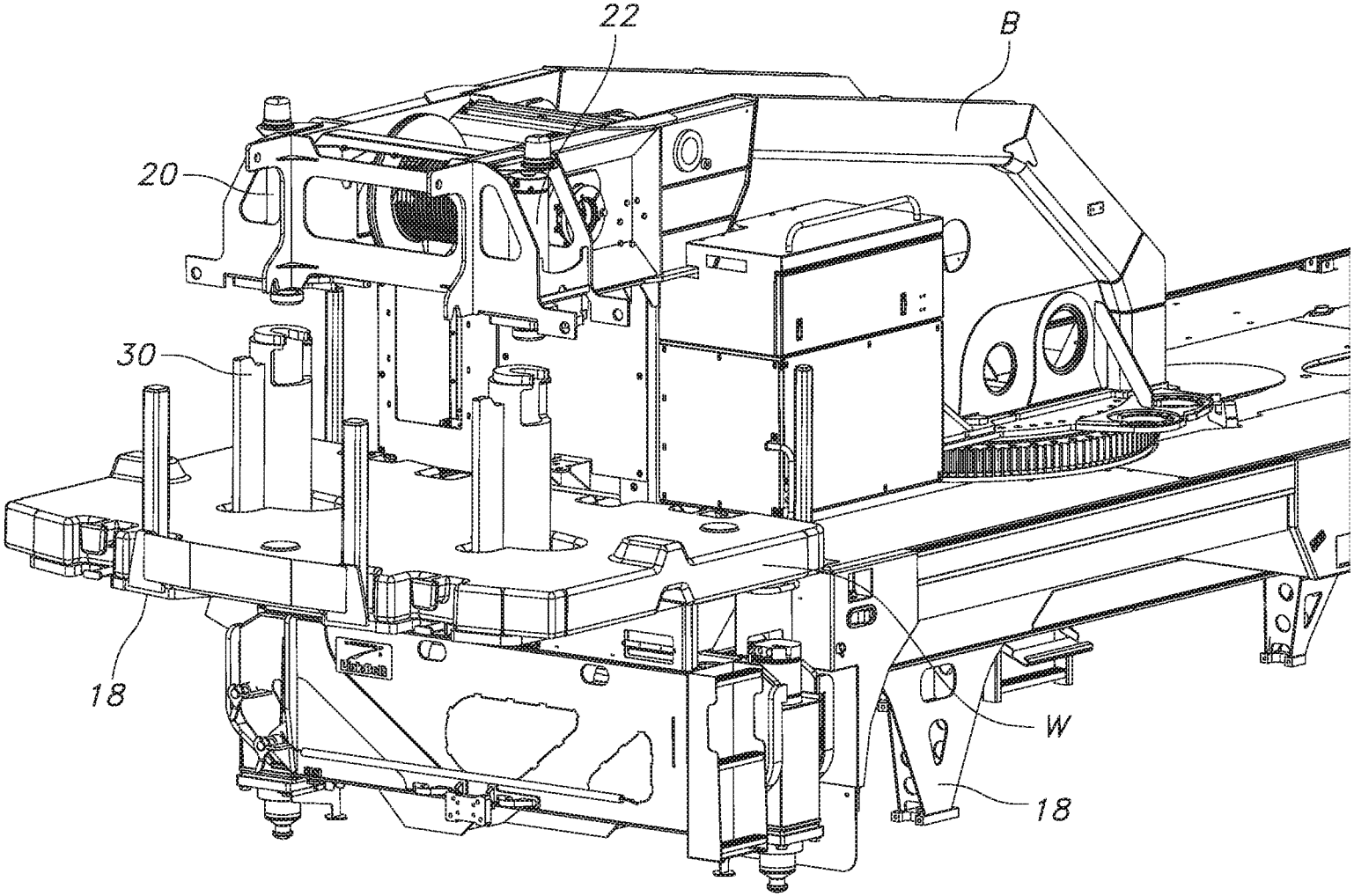
Figure 5A:
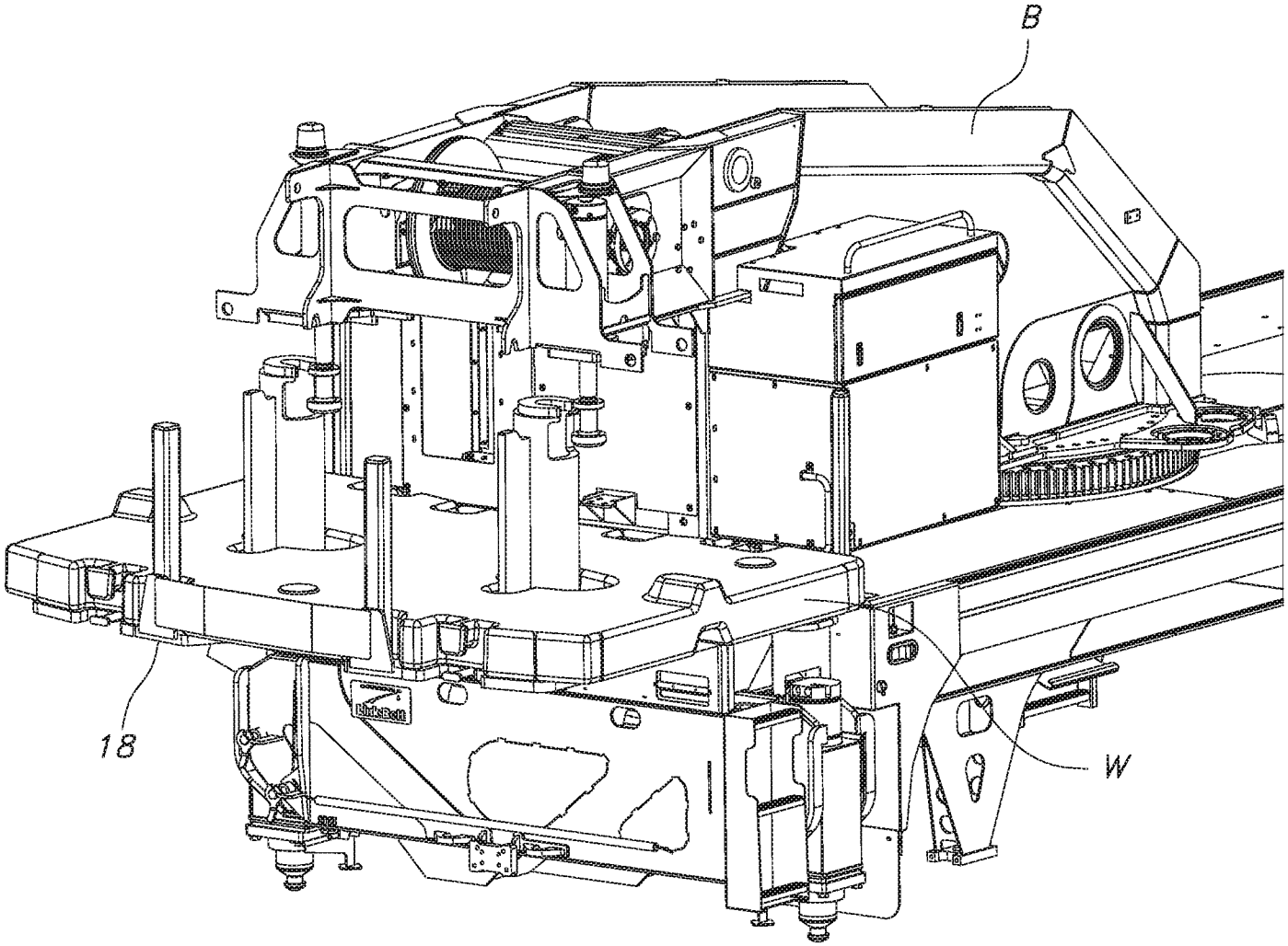
Figure 6:
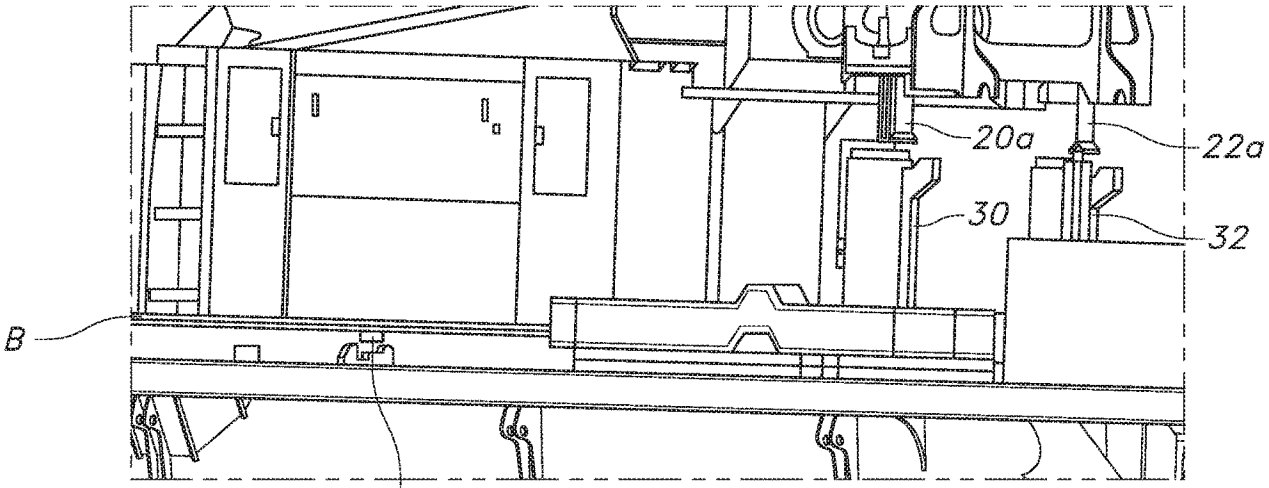
Figure 6A:
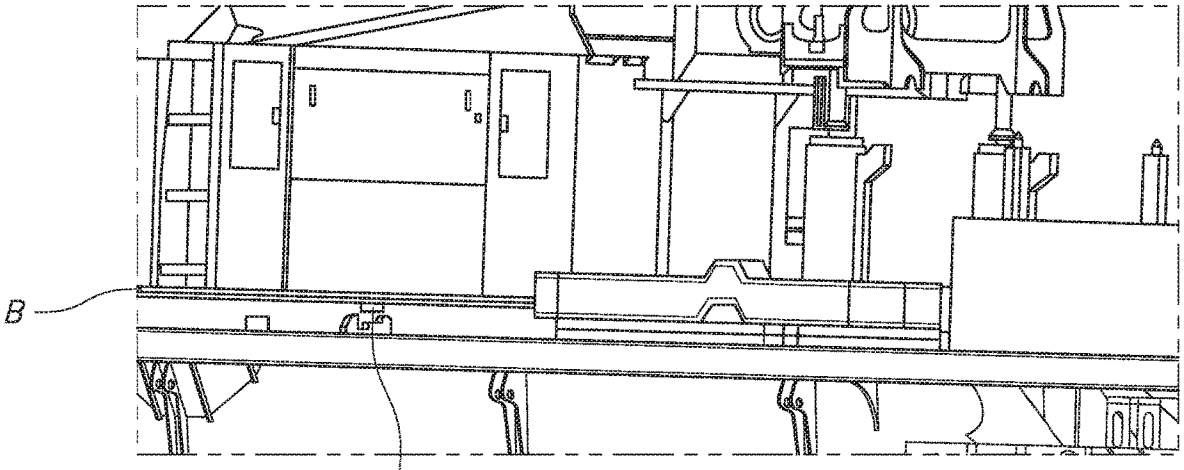
Figure 7:
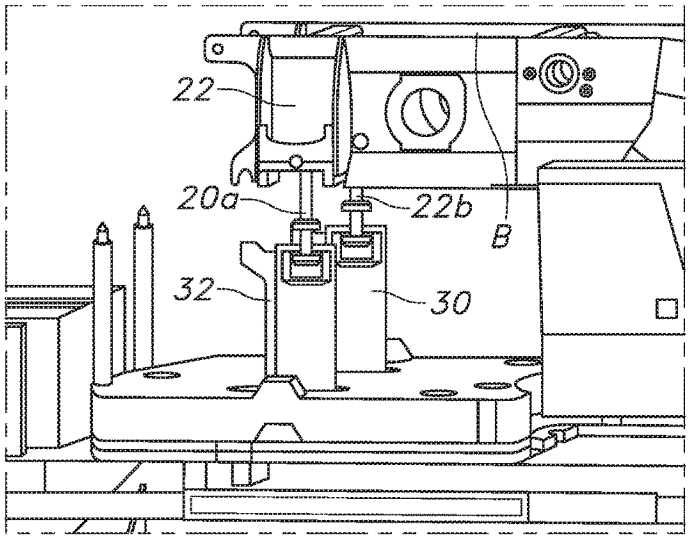
Figure 7A:
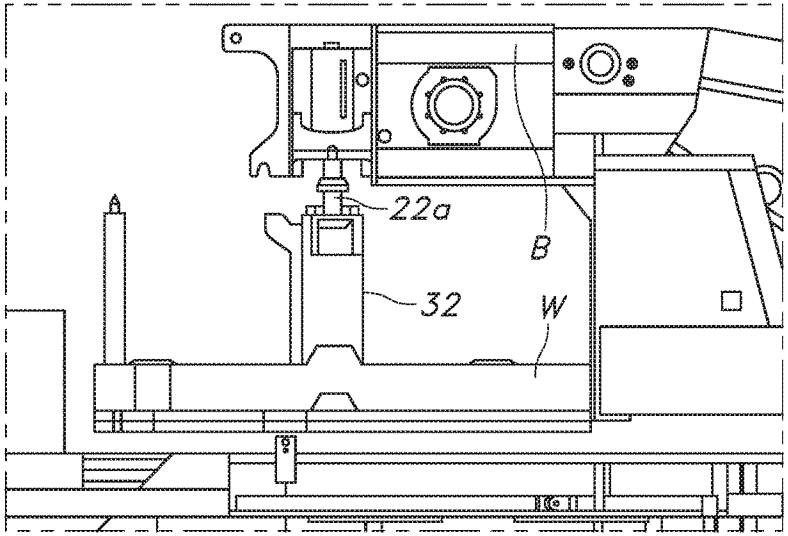
Figure 8:
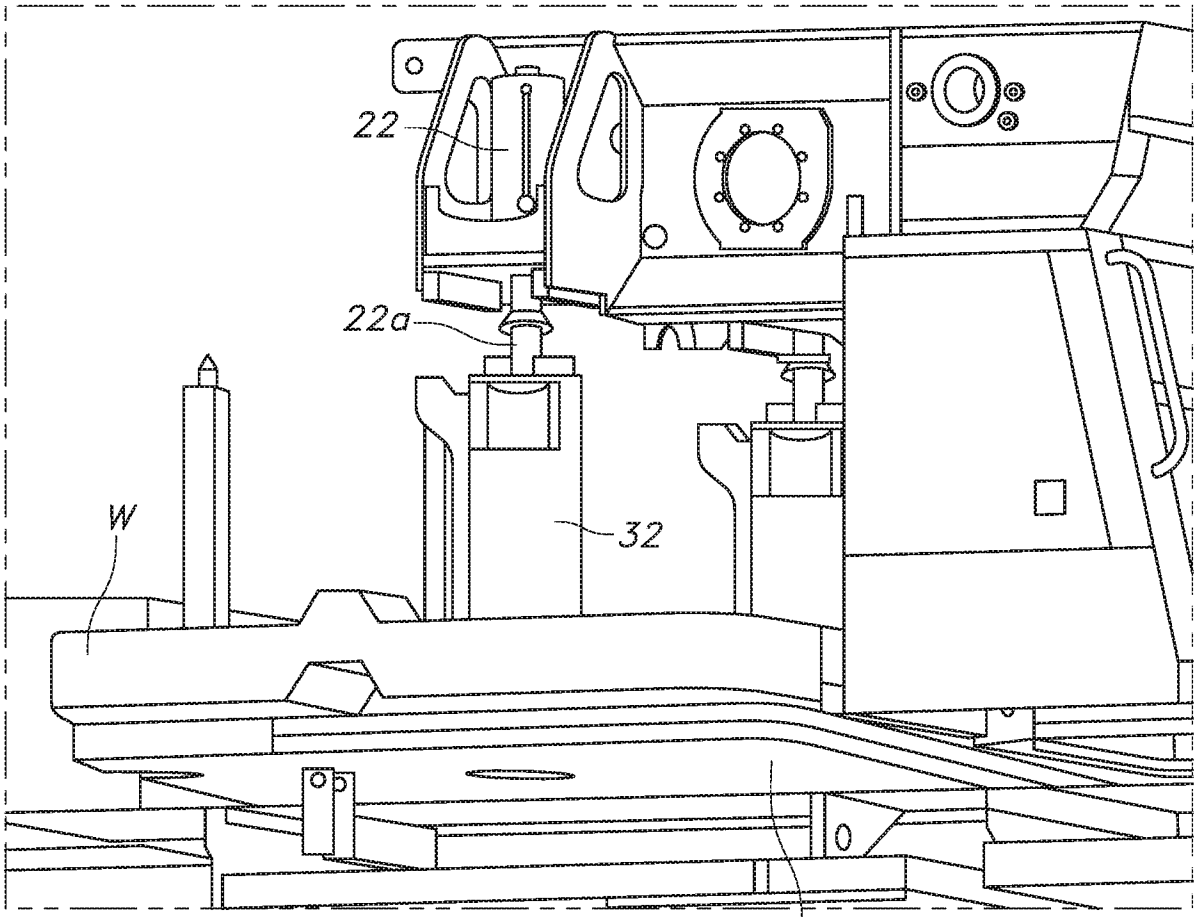
Figures 9, 9A, 9B, 9C, 9D:
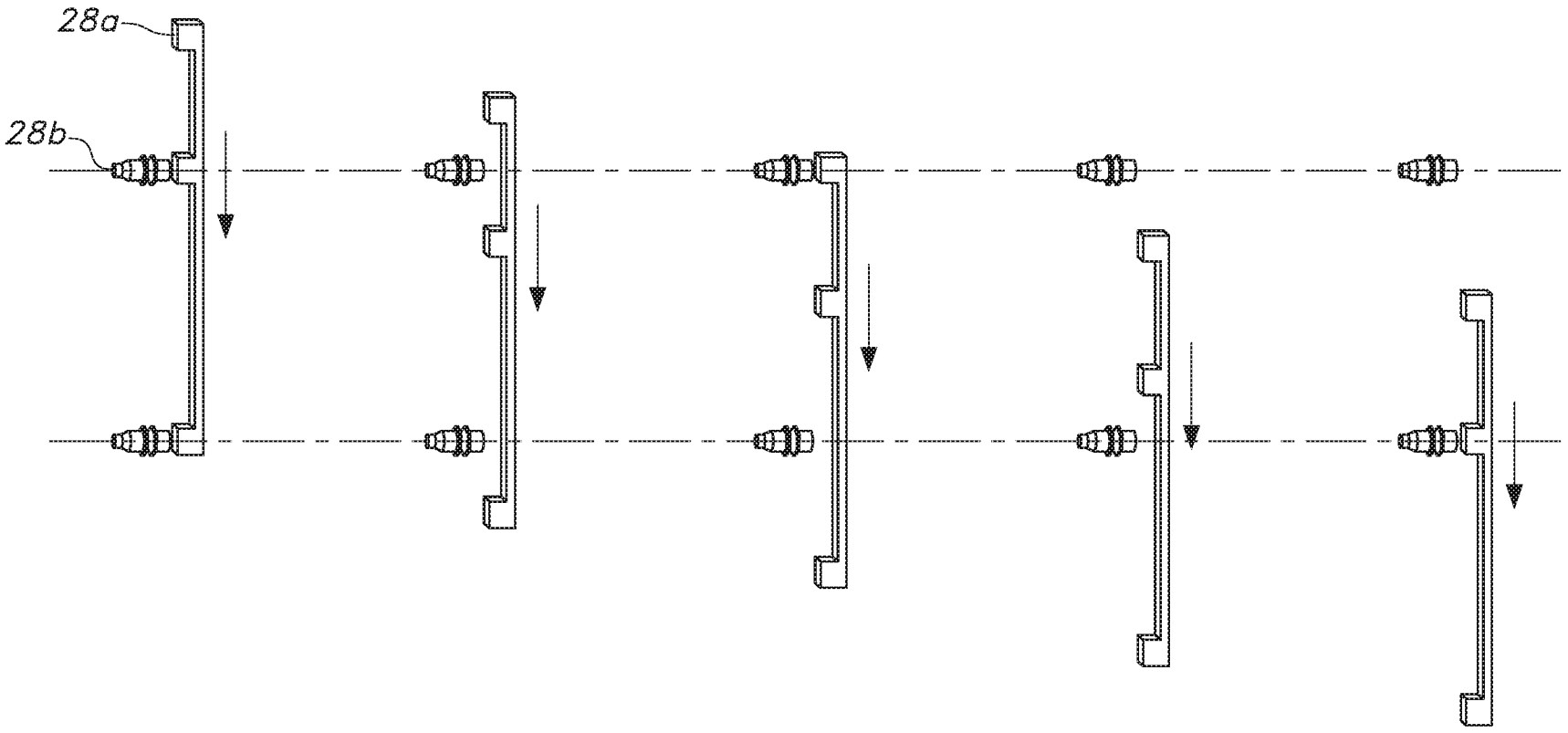
Figure 10:
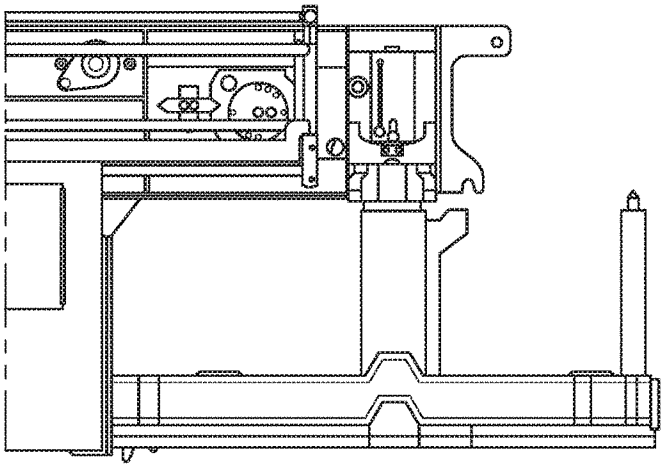
Figure 10B:
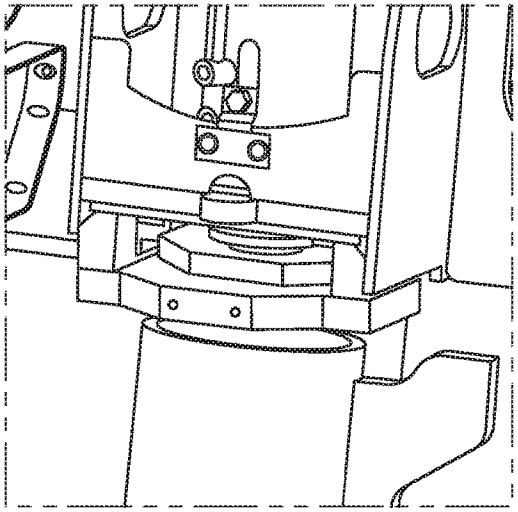
Figure 10A:
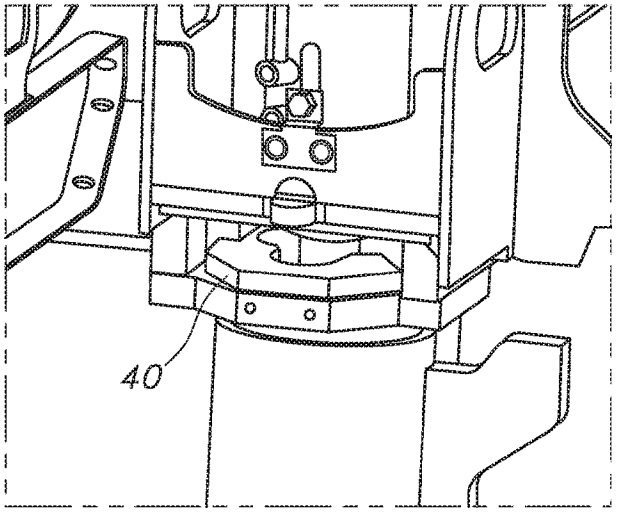

FIGS. 5 and 5*a* illustrated the manner in which the crane upper may be associated with the counterweight platform;

FIGS. 6 and 6*a* illustrate a lock pin that may be used to limit the movement of the crane upper;

FIGS. 7 and 7*a* illustrate the raising of the counterweight platform;

FIG. 8 illustrates the counterweight raised to a midpoint position;

FIGS. 9 and 9*a*-9*d* illustrate one possible manner of sensing the condition of the lifter; and FIGS. 10 and 10*a*-10*b* illustrate the manner in which the lifter may be locked in position once the counterweight is raised.

Reference will now be made in detail to the present embodiments of the counterweight sensing system and related methods, examples of which are illustrated in the accompanying drawing figures, wherein like numerals are used to represent like elements.

DETAILED DESCRIPTION

Figure 1:
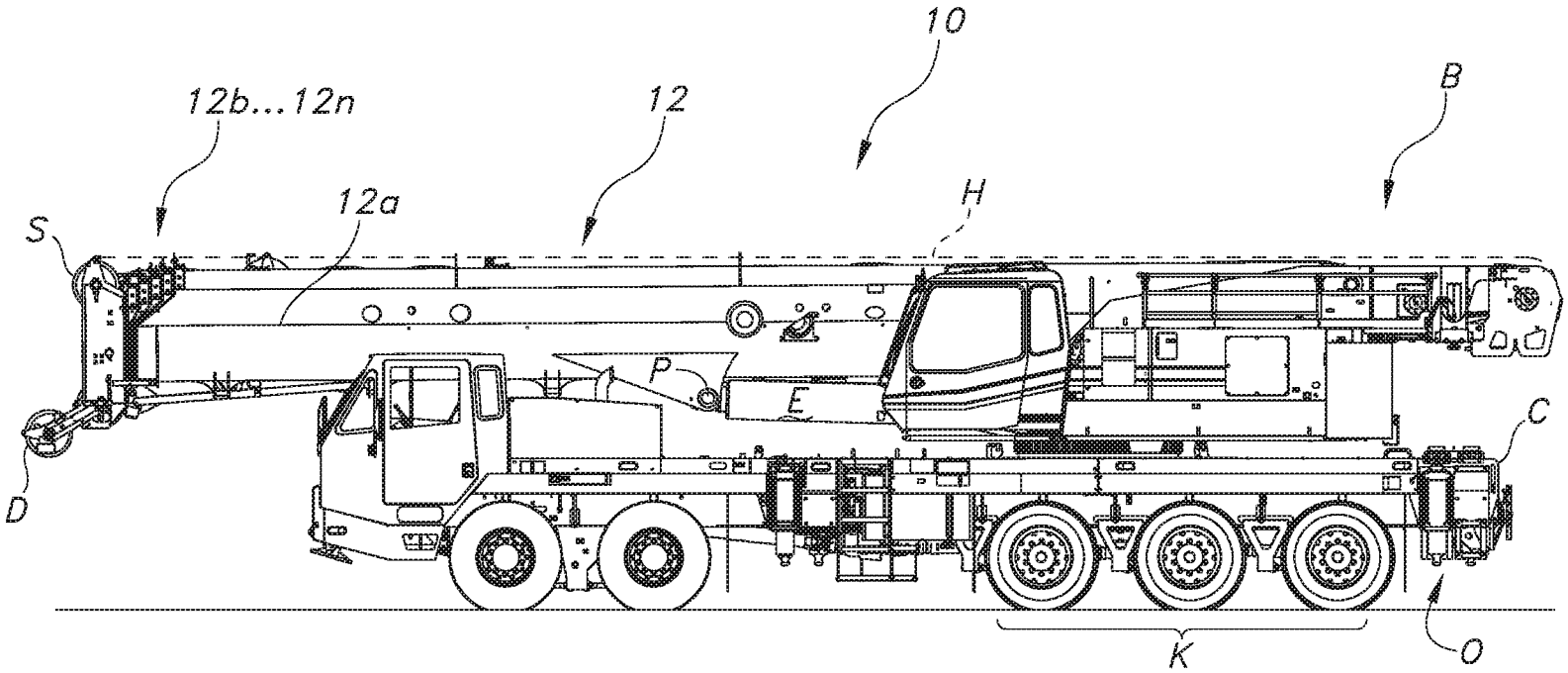
FIG. 1 is a side view illustrating one example of a lifting machine in the form of a crane with a telescoping boom to which the disclosed concepts may have applicability.
Figure 2:
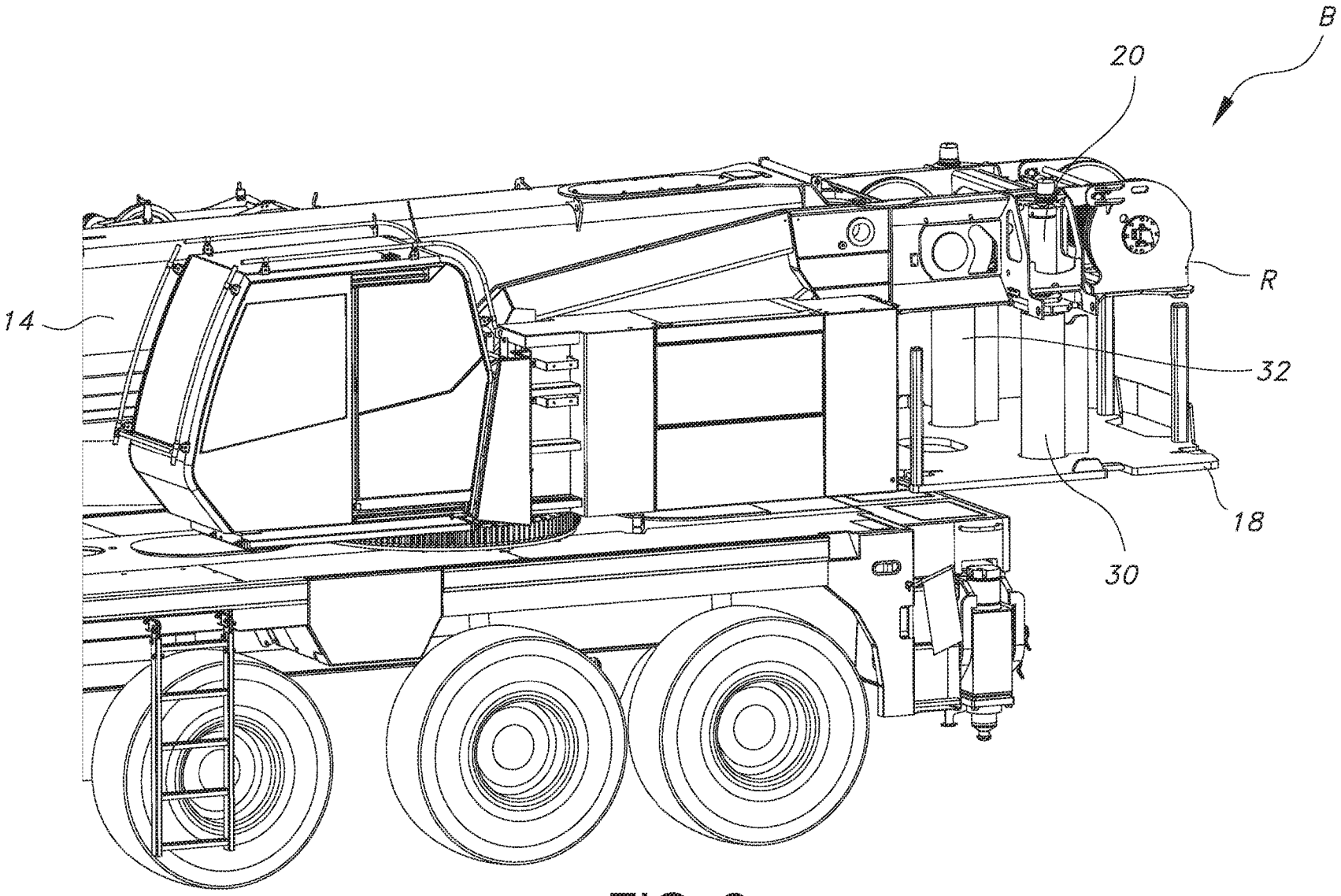
FIG. 2 is a partially cutaway view illustrating a counterweight assembly at the rear end of the crane for counterbalancing a load being lifted by the boom.
Figure 3:
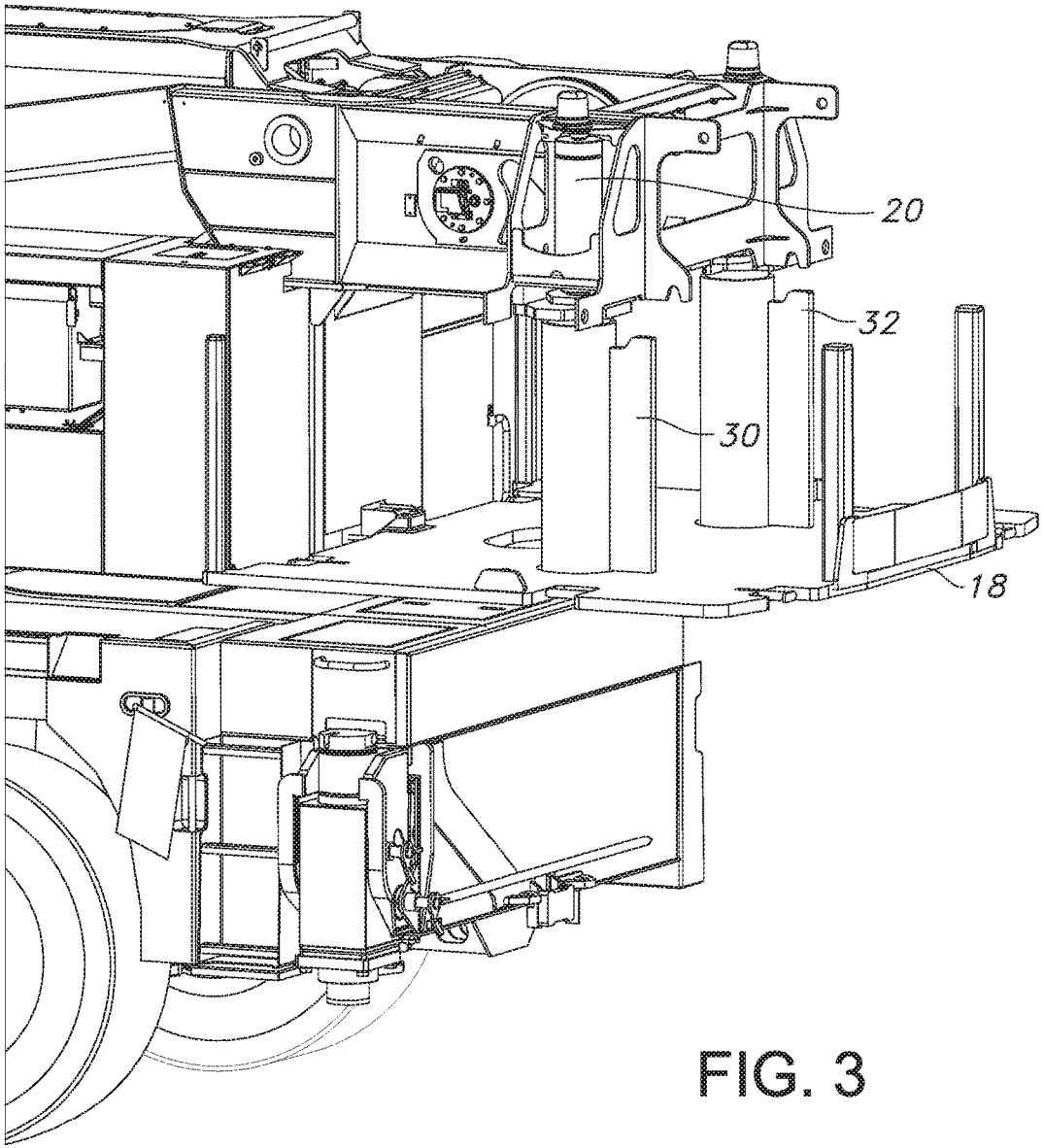
FIG. 3 is a rear view of a platform for supporting the counterweight.

Reference is now made to FIG. 1, which provides an overall view of a crane 10 for which the aspect of this disclosure may have utility. In the embodiment illustrated in FIG. 1, this crane 10 includes a main boom assembly 12 having at least two generally tubular boom sections 14, 16. The first or outer base boom section 14 is pivotally mounted on a bodily rotatable or slewing superstructure or base B. The base B in turn is supported by a chassis C having ground-engaging structures (e.g., wheels K for over-the-road travel; outriggers O when stationary and operative for lifting loads).

The second boom section 16 is telescopically received within the first or base boom section 14 and includes a head end 16*a* of the boom assembly 12. It should be appreciated that additional boom sections may be telescopically received within the second boom section 16 and so on to form intermediate sections of the boom assembly 12 when extended. An internal hydraulic cylinder (not shown) is provided to move the telescoping boom sections 14, 16 relative to each other in a manner known in the art.

A lifter, such as a boom hoist external cylinder E, pivots the entire boom assembly 12 in a vertical direction at a connection point P. A hoist rope H, such as a cable, is also connected to a hoist R at one end of the crane 10. The rope H extends over a sheave S at the head end 16*a*, and thus may be used in connection with the raising and lowering of the boom assembly 12 to carry and move loads.

With continued reference to FIG. 1 and also now referring to FIGS. 2-5, it can be understood that the base B is adapted for associating with a counterweight to help counteract any load being lifted by the boom assembly 12, such as using the hoist rope H. In the illustrated embodiment, the base B includes a platform or tray 18 adapted for connecting to the rear portion of the base and for receiving a counterweight in the form of one or more plates W forming the counterweight (see FIG. 1). The platform or tray 18 may be connected to the base B by one or more lifters, which in the illustrated example take the form of hydraulically actuated cylinders 20, 22 permanently connected to the base B, but may be disconnected prior to use and supported by an auxiliary structure (such as a carrier, trailer or the like). The cylinders 20, 22 may be actuated by an onboard hydraulic motor, which may be controlled by the operator from the crane cab.

Figure 4:
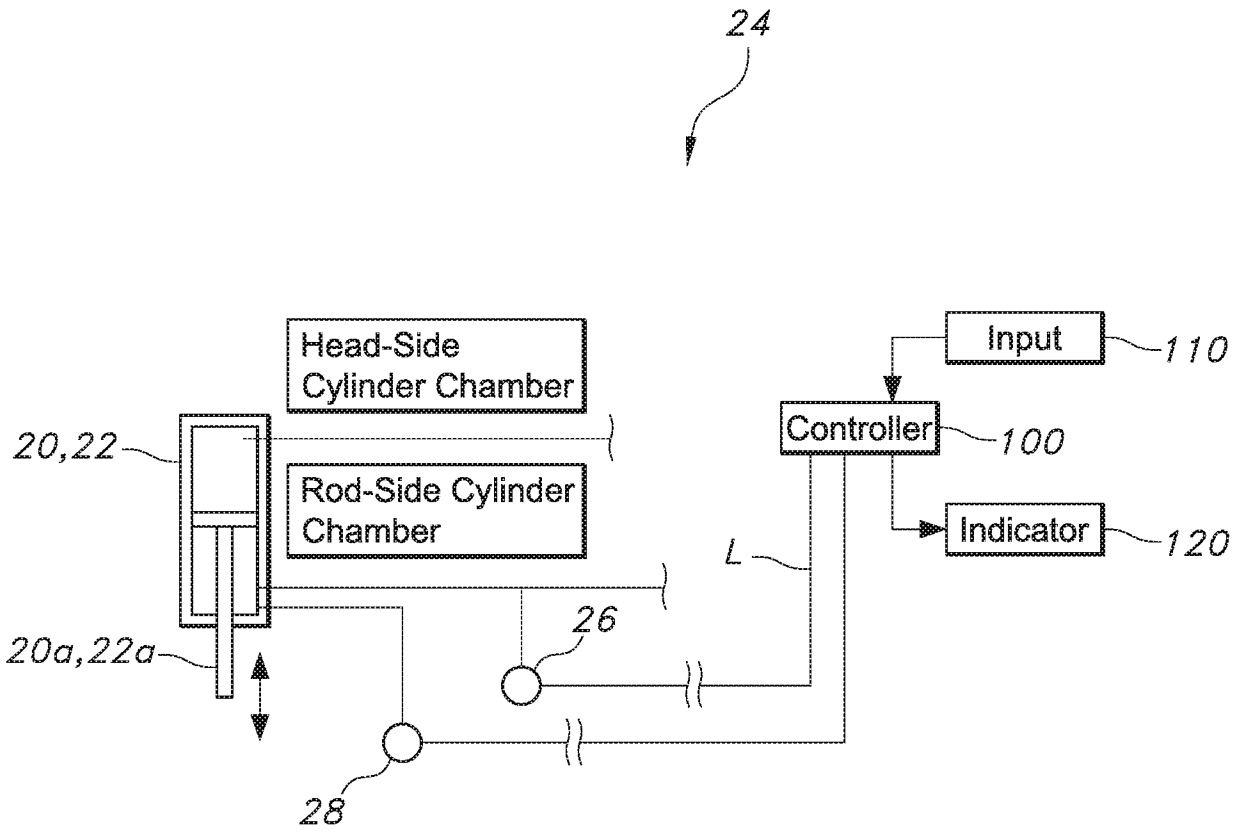
FIG. 4 is a schematic diagram illustrating one possible manner of control for the counterweight sensing system.

In accordance with one aspect of the disclosure, and with reference to the schematic diagram of FIG. 4, a system 24 is provided for allowing for the automatic detection of the amount of counterweight present using information obtained from the lifter, such as hydraulic cylinders 20, 22. The system 24 may include: (1) a pressure sensor 26 for sensing the pressure in one or both cylinders 20, 22; and (2) a position sensor 28 for determining the position of the counterweight, such as by determining the amount of extension of the extendable rod 20*a*, 22*a* associated with each cylinder 20, 22. The pressure sensor 26 may be associated with the hydraulic circuit on the side of each cylinder including the rod 20*a*, 22*a*, such as in the hydraulic line L near the cylinder. The position sensor 28 may also be associated with each cylinder 20, 22, and may be provided within it so as to check the stroke of the corresponding rod 20*a*, 22*a*, or external to it, as outlined further in the following description.

Using this system 24, the amount of counterweight present for use in connection with a lifting operation by the crane 10 may be determined automatically. In one exemplary embodiment, this may be achieved by extending the cylinders 20, 22 to engage corresponding portions of the tray or platform 18, which may be connectors, such as upstanding towers 30, 32 as shown in FIG. 5. The swing function of the base B relative to the chassis C may be disabled during the extending step (which may be evaluated using the position sensor(s) 28), and then moved into place, as indicated in FIG. 6, to pass into and engage the towers 30, 32 (FIG. 6A). A locking pin 34 may be used to limit the rotational movement of the base B, as indicated (FIG. 5A).

Once the connection with the platform or tray 18 is made, the cylinders 20, 22 are actuated to raise counterweight W, as shown in FIGS. 7 and 7A. The raising is continued until a predetermined point between the raised and lowered positions is reached, such as the midpoint (FIG. 8). The position may be determined by providing a position sensor 28 comprising an external support including a plurality of spaced position indicators 28*a* (such as magnets), and a plurality of spaced position sensors 28*b* (such as magnetic flux detectors) for sensing the position of the indicators. As indicated in FIGS. 9, in one possible embodiment, three indicators and sensors are providing in associated pairings for indicating the lowermost, mid-point and fully raised positions of each rod 20*a*, 22*a*, but other positions could be used (see, e.g., FIGS. 9A-9D). As noted above, a sensor internal to each cylinder 20, 22 for sensing the extended length of the rod 20*a*, 22*a* could also be used to determine its position.

Once it is sensed that the rod 20*a*, 22*a* has reached the mid-point position, the actuation of the cylinder 20, 22 may be halted, at least momentarily. In this halted condition, the output signal from the pressure sensor 26 may be evaluated (after which point the movement may be continued until the rods 20*a*, 22*a* are fully retracted, as determined by the position sensor(s) 28). Based on the pressure signal and a known correlation (e.g., through empirical analysis), the amount of counterweight present can be determined, such as by an onboard controller 100 associated with the crane 10, such as in the operator's cab.

Referring back to FIG. 4, the controller 100 may then query the operator to verify the amount of counterweight believed to be present, such as by using an associated input 110. In one possible example, this may be done by providing an indicator 120 for displaying to the operator the amount of counterweight present, such as by displaying the number of plates (if of a known weight, as is typical, which number can then be determined by dividing the weight of each plate by the sensed total weight). The user may then be asked to verify the amount of counterweight present, which may be done using the input 110. If the correct amount is not verified, then the controller 100 may cause the indicator 120 to indicate the discrepancy, thus requiring the operator to reexamine the situation. The controller 100 could also create a lock out situation, such that operation of the crane 10 is disabled until the proper verification is provided by the operator.

If the proper amount of counterweight is verified by the operator as present, then the operation of the crane 10 may commence, such as by using it to lift a load appropriate for the amount of counterweight present and any other conditions present. In this regard, a lock may be engaged to ensure that the counterweight remains held in the active position during further operation. As indicated in FIG. 10, this may be achieved using a locking plate 40 to ensure that each cylinder 20, 22 remains in the raised position. The locking plate 40 may include an opening for receiving the corresponding rod 20*a*, 22*a* of each cylinder 20, 22, and may be moved into a position for preventing the rod from lowering once engaged (FIG. 10B). When it is desired to lower the counterweight, the plates 40 may simply be moved to the unlocked condition (FIG. 10A), at which point the operation may proceed unfettered.

The foregoing description of certain embodiments provides an illustration of the principles of the invention and its practical application to thereby enable one of ordinary skill in the art to utilize the invention in various embodiments and with various modifications as are suited to the particular use contemplated. For example, while a mobile crane with a telescoping boom is shown in the figures, it can be appreciated that the disclosed aspects may be applied to any type of lifting vehicle that uses counterweights. All such modifications and variations are within the scope of the invention as determined by the appended claims when interpreted in accordance with the breadth to which they are fairly, legally and equitably entitled.

The invention claimed is:

1. A lifting machine including a counterweight for counterbalancing a load being raised or lowered by an associated boom, comprising:

a lifter for moving the counterweight from a lowered position to a raised position;

a first sensor associated with the lifter for sensing a first parameter corresponding to an amount of the counterweight; and a second sensor for sensing a condition of the lifter.

2. The lifting machine of claim 1, wherein the lifter comprises a first cylinder, and the first sensor comprises a first pressure sensor associated with a rod end of the first cylinder of the lifter.

3. The lifting machine of claim 2, wherein the second sensor comprises a sensor for determining a position or extended length of the rod of the first cylinder.

4. The lifting machine of claim 3, wherein the lifter comprises a second cylinder, and the first sensor further comprises a second pressure sensor associated with a rod end of the second cylinder of the lifter.

5. The lifting machine of claim 1, further including a controller for receiving an output signal from the first sensor and determining the amount of the counterweight present.

6. The lifting machine of claim 5, wherein the controller is adapted to stop the lifter upon determining that the lifter has reached a position between the lowered position and the raised position.

7. The lifting machine of claim 5, further including an input for allowing an operator to verify that the amount of counterweight determined by the controller is correct.

8. The lifting machine of claim 7, further including a lock for locking the lifter once the operator verifies the amount of counterweight is correct.

9. The lifting machine of claim 1, further including a platform adapted for supporting the counterweight, and wherein the lifter is adapted for connecting to a tower on the platform.

10. A lifting machine for associating with a counterweight for counterbalancing a load being raised or lowered by an associated boom, comprising:

a platform adapted for supporting the counterweight;

a first cylinder including a rod adapted for being releasably connected to the platform and for moving the platform from a lowered position to a raised position; and a pressure sensor for sensing an amount of pressure associated with a rod end of the cylinder.

11. The lifting machine of claim 10, further including a first position sensor for outputting a signal representative of a position of the rod of the first cylinder.

12. The lifting machine of claim 11, further including a second cylinder and a second pressure sensor associated with a rod end of the second cylinder.

13. The lifting machine of claim 12, further including a second position sensor for outputting a signal representative of a position of the rod of the second cylinder.

14. The lifting machine of claim 10, further including a controller for receiving a pressure signal from the pressure sensor and determining the amount of the counterweight on the platform.

15. The lifting machine of claim 14, wherein the controller is adapted to stop the first cylinder upon determining that the first cylinder has reached a pre-determined point between the lowered position and the raised position.

16. The lifting machine of claim 15, further including an input for allowing an operator to verify that the amount of counterweight determined by the controller is correct.

17. The lifting machine of claim 16, further including a lock for locking the first cylinder once the operator verifies the amount of counterweight is correct.

18. A method of operating a crane, comprising:

raising a counterweight using a lifter associated with the crane;

sensing a condition and a position of the lifter; and based on the sensed condition and position, determining the amount of counterweight present.

19. The method of claim 18, wherein the lifter comprises a cylinder, and the sensing step comprises determining a pressure associated with the cylinder during a pause in the raising step.

20. The method of claim 18, wherein the sensing of the position comprises sensing whether the lifter is at a raised position, a lowered position, or a position between the raised and lowered position.

21. The method of claim 18, further including the step of polling an operator to verify the amount of counterweight present.

22. A method of operating a crane using a controller, the controller programmed for performing steps, comprising:

automatically sensing an amount of counterweight associated with the crane; and polling an operator of the crane to verify the amount of the counterweight present.

23. The method of claim 22, wherein the method further includes raising the counterweight using a lifter associated with the crane, and the sensing step comprises determining a condition of the lifter during a pause in the raising step.

24. The method of claim 23, wherein the sensing step further comprises sensing: (a) whether the lifter is at a raised position, a lowered position, or an intermediate position between the raised and lowered position; and (b) a pressure condition associated with the lifter at the intermediate position.

25. The method of claim 22, wherein the polling step comprises providing an input to allow the operator to input the amount of the counterweight, or verify that the sensed amount is correct.

* * * * *